United States Patent [19]

Huntzinger

[11] Patent Number: 4,952,814

[45] Date of Patent: Aug. 28, 1990

[54] TRANSLATING APERTURE ELECTRON BEAM CURRENT MODULATOR

[75] Inventor: Calvin J. Huntzinger, Redwood City, Calif.

[73] Assignee: Varian Associates, INc., Palo Alto, Calif.

[21] Appl. No.: 366,000

[22] Filed: Jun. 14, 1989

[51] Int. Cl.[5] ..... H01J 33/04

[52] U.S. Cl. ..... 250/505.1; 250/492.3; 313/420; 328/233; 328/228

[58] Field of Search ..... 250/505.1, 492.3; 313/420; 328/233, 228

[56] References Cited

U.S. PATENT DOCUMENTS

| | | | |
|---|---|---|---|
| 2,670,440 | 2/1954 | Gordon et al. | 313/420 |
| 2,730,637 | 1/1956 | Atler | 313/420 |
| 3,720,828 | 3/1973 | Nablo | 328/228 |
| 4,061,944 | 12/1977 | Cray | 313/420 |
| 4,324,980 | 4/1982 | Symmons | 250/505.1 |
| 4,461,972 | 7/1984 | Dmitriev et al. | 313/420 |
| 4,507,614 | 3/1985 | Prono et al. | 328/228 |

OTHER PUBLICATIONS

"Electron Scattering and Collimation System for A 12 MeV Linear Accelerator", Bjarngard, et al., *Medical Physics,* 3, No. 3, 1976.

"Angular Distribution and Yield from Bremsstrahling Targets", Nordell et al., *Physis in Medicine and Biology,* 29, No. 7, 1984.

*Primary Examiner*—Janice A. Howell
*Assistant Examiner*—Kiet T. Nguyen
*Attorney, Agent, or Firm*—Peter J. Sgarbossa; Gerald M. Fisher; Stanley Z. Cole

[57] ABSTRACT

A microwave electron accelerator has a very limited range over which pulse beam current can be adjusted without destabilizing the operation of the machine. Therefore, means must be devised to reduce current without seriously reducing energy, or producing unwanted x-rays. One means includes spreading the beam in a scattering foil and subsequently absorbing the outer portion with a blocking wall. In order to make the means adjustable the foil thickness, the size of a passing aperture in the blocking wall or the position of the blocking wall can be adjusted.

17 Claims, 3 Drawing Sheets

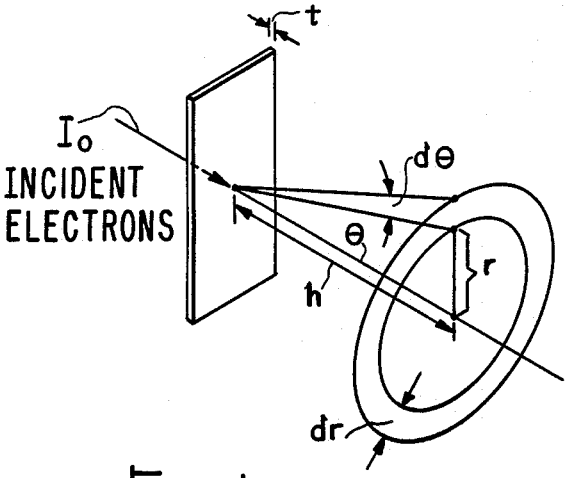
FIG.1
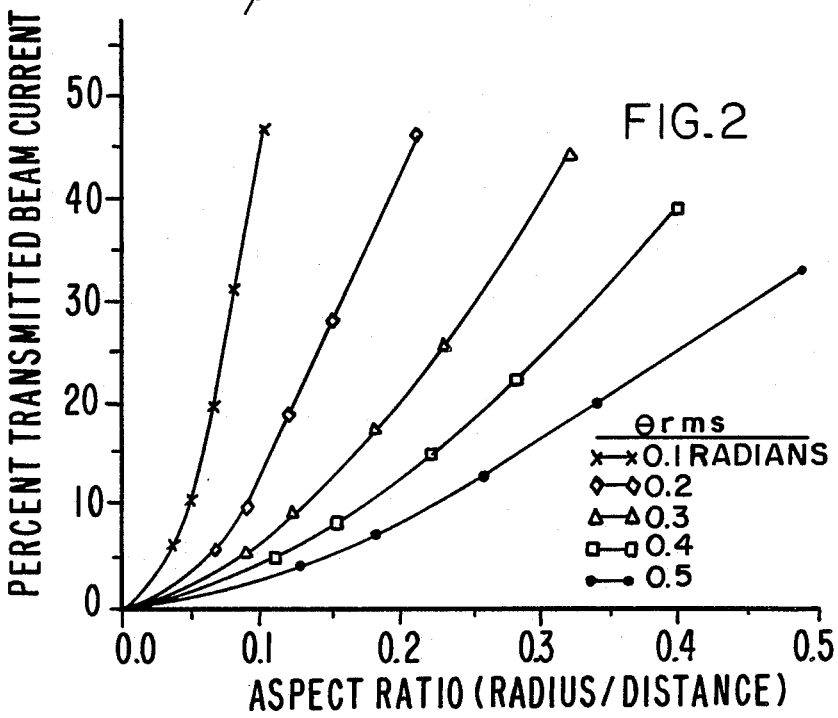
FIG.2
FIG.3
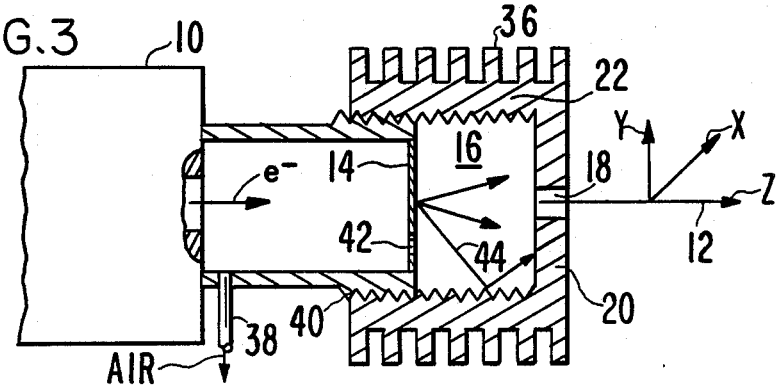

TRANSLATING APERTURE ELECTRON BEAM CURRENT MODULATOR

FIELD OF THE INVENTION

This invention pertains to an apparatus for reducing the output current from an electron accelerator.

BACKGROUND OF THE INVENTION

Most microwave electron accelerators have the capability of varying pulse beam current by changing the amount of current injected into the accelerator structure. However, each accelerator structure or component which supplies current to the structure, has a limited dynamic range over which it will operate efficiently.

Decelerators, made from low-atomic number materials such as carbon, can be used to reduce the transmitted beam current as well as the energy of the accelerated electrons. However, in some cases it is required to reduce only the beam current while maintaining the high initial electron energy. In addition, the low-atomic number materials will induce electron energy straggling which will adversely effect the surface dose distribution for some applications.

One or more scattering foils can be made from high-atomic number materials such as tantalum or lead. However, high-atomic number materials produce x-rays efficiently which is unacceptable for some applications. Also, the dose rate from the electrons can be reduced as the reference point is moved away from the scattering foil but this may take separation distances that are unpractically large. The beam current can be reduced by using multiple scattering foils, but the total thickness of the foils required to reduce the beam current for a particular application may reduce the electron energy by an unacceptable amount.

If there is some energy spread in the accelerated electron beam, momentum analysis may be used to remove a portion of the beam current. The momentum analyzer typically takes the form of a magnet with slits that define a specific trajectory in the magnetic field, hence a specific energy. For some applications, the cost, complexity and size of the momentum analyzing system is not acceptable.

OBJECTIVES OF THE INVENTION

Objects of the invention are to provide a method and apparatus for reducing the output current of an electron accelerator with minimal reduction of electron energy and minimum production of x-rays.

SUMMARY OF THE INVENTION

These objects of the invention and other objects, features and advantages to become apparent as the specification progresses are accomplished by the invention according to which, briefly stated, a scattering foil is combined with a heavy plate with an aperture which is moveable relative to the scattering foil with all mounted in a shielded heat sink chamber. The plate with aperture and chamber absorb an outer portion of the scatter beam current.

These and further constructional and operational characteristics of the invention will be more evident from the detailed description given hereinafter with reference to the figures of the accompanying drawings which illustrate one preferred embodiment and alternatives by way of non-limiting examples.

GLOSSARY

The following is a glossary of elements and structural members as referenced and employed in the present invention.

10 electron accelerator
12 z-axis or central axis of the electron beam
14 scattering foil
16 low-density, low-atomic number region
18 aperture in thick wall
20 thick wall
22 chamber
24 second scattering foil
26 high atomic number "button"
28 low-density foil
30 x-ray target
32 scattering foil of low-atomic number material
34 high atomic number shielding material
36 cooling fins
38 air vent
40 screw threads
42 vent hole
44 electron trajectory
46 drive screw
48 linear bearing
50 liquid cooling lines

BRIEF DESCRIPTION OF THE DRAWINGS

FIG. 1 shows the geometry defining variables in multiple scattering when $F(\theta)$ is the angular distribution.

FIG. 2 is a graph of percent transmitted beam current versus aspect ratio.

FIG. 3 shows a diagram of a longitudinal section of the preferred embodiment of the invention.

DESCRIPTION OF THE PREFERRED EMBODIMENTS

Figure 4:
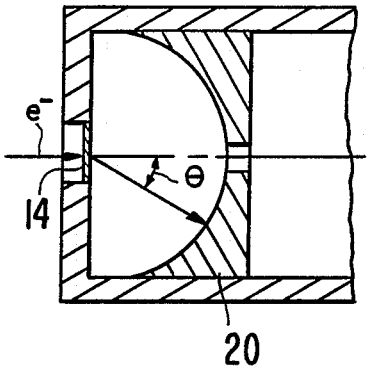
FIGS. 4 through 11 show diagrams of longitudinal sections of alternate embodiments of the invention.

When a narrow parallel beam of electrons, as is typically produced by electron accelerators, strikes a thin scattering foil, the small-angle, multiple-scattering of the electrons results to a good approximation in a two-dimensional gaussian distribution. Please refer to FIG. 1. $I_0F(\theta)\sin(\theta)d\theta$ is the number of electrons from the incident beam $I_0$ scattered into a polar ring of width $d\theta$ at polar angle $\theta$. For electron scattering which can be described by a gaussian distribution, the root-mean-square scattering angle, typically denoted $\theta$rms or simply $\theta$, is the same as the standard deviation. This is the angle at which the distribution drops to $e^{-\frac{1}{2}}$ or approximately 61%. It should be noted that the angular distribution function, is independent of azimuth. Therefore the number given by $F(\theta)\sin(\theta)d\theta$ will be distributed in an annular cone about the axis of the incident electron beam. The rms scattering angle of electrons decreases with increasing electron energy, decreasing atomic number of the scattering material and with decreases in the square root of the scattering material thickness. The resulting electron scattering produced by a scattering foil can be integrated in two dimensions. FIG. 2 shows the percentage of the total electron beam current falling within a circle as a function of the aspect ratio r/h (where r is the radius of the circle and h is the distance from the scattering foil) and the rms scattering angle induced by the scattering foil. The circle radius, r, and the distance from the scattering foil, h, have the same meaning as shown in FIG. 1.

As shown in FIG. 3, an electron accelerator 10 produces an electron beam along the z-axis 12. The beam passes through a scattering foil 14 on the beam axis which is thermally connective through its mounting means for example to the chamber 22. The scattering foil should be made from high-atomic number materials, since they produce the greatest amount of electron scatter per unit of electron energy lost. The rms scattering power first increases linearly with the square root of the foil thickness, since the scattering events are statistically independent, but reaches an equilibrium value of approximately 0.8 radians, which occurs at depths beyond $\frac{1}{3}$ to $\frac{1}{2}$ of the practical range of the electrons in the material. When the rms scattering angle approaches this limit the electrons are said to be in a state of full diffusion. The exact thickness where the rms scattering angle no longer increases, is dependant on the energy of the electron beam and the atomic number of the scattering material. The thickness of the scattering foil 14 should be chosen to be less than the thickness of full diffusion, otherwise the electron energy is reduced in the scattering foil with no additional increase in scattering angle. To be conservative, the thickness of the scattering foil should be chosen so that it produces a rms scattering angle that is less than 0.7 radians.

Table 1 shows the rms scattering angles of electrons undergoing multiple scattering in 0.001 inch of the indicated material except for beryllium, which is 0.010 inch and air, which is 2 inches thick at standard temperature and pressure. Units of $\theta$ are radians. The scattering angle will increase with the square root of the thickness of the scattering foil, e.g., doubling the foil thickness will increase the rms scattering angle by a factor of 1.4. For other materials, the rms scattering angle can be scaled approximately linearly with atomic number. The angle is approximately inversely proportional with electron energy and thus energy dependence can be interpolated from the table.

TABLE 1

RMS scattering angles (radians) of electrons undergoing multiple scattering in a variety of materials and for a range of electron energies.

| Material | Be | Al | Ti | Fe | W | Pb | Air |
|---|---|---|---|---|---|---|---|
| Thickness (in) | 0.010 | 0.001 | 0.001 | 0.001 | 0.001 | 0.001 | 2.0 |
| Density ($gm/cm^3$) | 1.8 | 2.7 | 4.5 | 7.8 | 19.3 | 11.3 | 0.0012 |
| Energy (MeV) | | | | | | | |
| 1 | 0.263 | 0.184 | 0.295 | 0.422 | — | — | 0.135 |
| 2 | 0.154 | 0.108 | 0.174 | 0.249 | 0.592 | 0.471 | 0.080 |
| 4 | 0.088 | 0.062 | 0.098 | 0.143 | 0.341 | 0.272 | 0.045 |
| 6 | 0.062 | 0.044 | 0.071 | 0.102 | 0.244 | 0.194 | 0.032 |
| 8 | 0.049 | 0.034 | 0.055 | 0.079 | 0.190 | 0.152 | 0.025 |
| 10 | 0.040 | 0.028 | 0.046 | 0.065 | 0.157 | 0.125 | 0.021 |
| 15 | 0.028 | 0.020 | 0.032 | 0.046 | 0.109 | 0.087 | 0.014 |
| 20 | 0.021 | 0.015 | 0.025 | 0.035 | 0.085 | 0.067 | 0.011 |
| 30 | 0.015 | 0.010 | 0.017 | 0.024 | 0.058 | 0.046 | 0.008 |

The electrons traverse a low-density, low-atomic number region 16 such as air, until they encounter an aperture 18 in a thick plate or wall 20. The aperture 18 extends in the x-y plane, with a fixed opening, and is symmetric about the z-axis. The aperture can be manually translated along the z-axis in a chamber 22 by a screw-thread mechanism 40. The radius of the fixed aperture opening, r, the aperture range of translation with respect to the scattering foil, h, and the rms scattering angle produced by the scattering foil are selected to produce the required beam current reduction. Various workable combinations of the fixed aperture radius, distance from the scattering foil and rms scattering angle can be chosen from FIG. 2, starting with the required beam current reduction.

For example, assume a 2 MeV electron beam needs to be reduced by 90% (10% transmitted beam). In this special case, assume a 0.005" thick aluminum foil rather than a high atomic number material. Aluminum is assumed because of its superior thermal conductivity properties compared to most high-atomic number materials. From Table 1, this thickness of aluminum will produce an rms scattering angle of 0.242 radians. Assume a distance, h, between the scattering foil and aperture of 3.500" and an aperture opening radius of 0.313". The aspect ratio (r/h) is 0.09. From FIG. 2, an aspect ratio of 0.09 and a scattering angle of 0.242 radians will transmit approximately 7% of the electron beam.

The thickness of the thick wall 20 and the chamber 22 side walls are chosen to be grater than the extrapolated range of the electrons in the particular material they are made from. They should be made from low-atomic number materials such as carbon or aluminum and may be connective shown to permit heat dissipation through thermal conductivity. Low-atomic number materials have the lowest electron backscatter coefficients for a given electron energy, so that they tend to absorb rather than rescatter incident electrons. Also, low atomic number materials have the lowest radiative stopping powers, so that absorbed electrons tend to give up their kinetic energy in the form of heat rather than the production of bremsstrahlung (x-rays).

The radial extent of the thick wall 20 for the aperture, i.e., the distance between the central axis 12 and the side walls of the chamber 22 should be chosen such that no electron trajectory 44 can be drawn from the point where the electron beam strikes the scattering foil to a point through the aperture, with only one scattering interaction at some point on the side wall.

The translating aperture and side walls may be cooled. In FIG. 3, cooling fins 36 are shown. Air may be forced over the cooling fins to increase heat transfer. The high intensity electron beam currents present in the low-density region 16 defined by the translating aperture and the side walls, may produce ozone. This ozone may be removed by ventilation schemes such as air vent 38 which draws air from region 16 through a vent hole in the scattering foil 42. Replacement air is drawn into region 16 through the aperture 18.

A translating aperture beam-current controlling device has been built and successfully tested. A microwave accelerator produces an electron beam of 190 mA in bursts of about 3 microseconds duration and at a mean electron energy of about 1.2 MeV in nominal 1 MeV operating mode and 2.6 MeV in the nominal 2 MeV operating mode. The electron beam impinges on a 0.005 inch thick aluminum scattering foil. The translating aperture is made from 0.375 inch thick aluminum with a 0.625 inch opening. The side walls are 0.250 inch thick aluminum and the inner diameter of the low-density region is 4.0 inches. For the nominal 1 MeV operating mode, the aperture is positioned 0.125 inch from the 0.005 inch thick aluminum scattering foil. For the nominal 2 MeV operating mode, the aperture is positioned 3.500 inches from the aluminum scattering foil. For this particular application, the translating aperture device is used in conjunction with a scattering foil system, similar to the alternate embodiment shown in FIG. 5 and described hereinafter.

FIG. 4 shows an alternate embodiment of the translating aperture device where the thick aperture wall 20 is curved such that a trajectory from the point where the electron beam strikes the scattering foil 14 to the thick aperture wall, would be normally incident upon the wall 20. This would maximize electron absorption rather than scattering.

Figure 5:
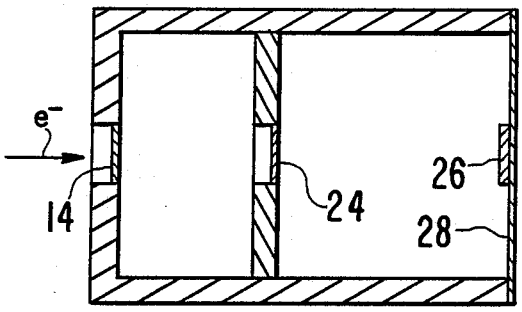

FIG. 5 shows an alternate embodiment of the translating aperture device with the incorporation of a second high-atomic number scattering foil 24 and a high-atomic number button 26 supported on a low-density structure 28 such as an aluminum foil. This combination can be used to spread and flatten the distribution of electrons for therapeutic applications, such as described in the report "Electron Scattering And Collimation System For A 12 MeV Linear Accelerator," Bjarngard, et al, *Medical Physics,* 3, No. 3, 1976.

Figure 6:
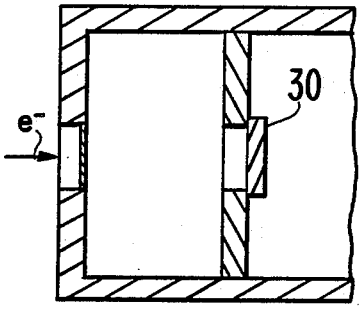

FIG. 6 shows an alternate embodiment of the translating aperture device with the incorporation of a x-ray target 30. Such a design would produce an x-ray exposure rate with a wide dynamic range. The design of x-ray targets has been described in the technical literature, such as "Angular Distribution And Yield From Bremsstrahling Targets," Nordell et al, *Physics In Medicine And Biology,* 29, No. 7, 1984.

Figure 7:
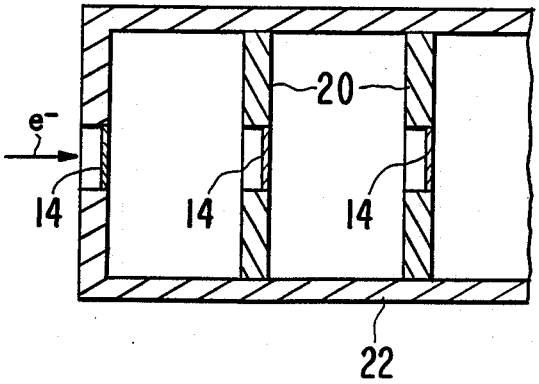

FIG. 7 shows an alternate embodiment of the translating aperture device where several, in this particular example three, translating apertures have been joined to produce a larger possible dynamic range of transmitted beam current than could be readily achieved with one translating aperture alone.

Figure 8:
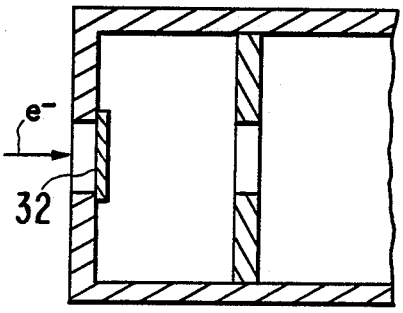

FIG. 8 shows an alternate embodiment of the translating aperture device where the scattering foil 32 is made from a low-atomic number material. Typically, the scattering foil would be made from a high-atomic number material, since high-atomic number materials produce the most electron scatter per unit of electron energy lost. Low-atomic number materials require greater electron energy loss per unit scatter, hence both the electron beam current and to a lesser extent, the electron energy could be controlled in unison by such an alternate embodiment.

Figure 9:
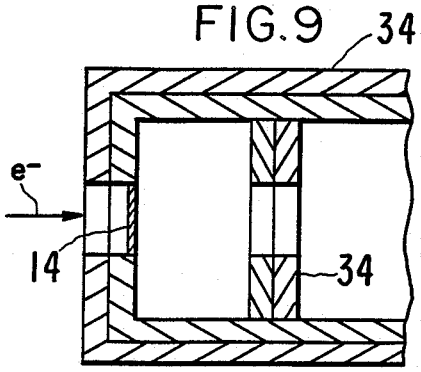

FIG. 9 shows an alternate embodiment of the translating aperture device where the high-atomic number shielding material 34 such as tungsten, lead or tantalum has been added as an integral member of the translating aperture and the side-walls. Shielding added in this manner would be the most efficient way to reduce the intensity of any x-rays produced in the aperture or side walls. For some applications, the reduction of x-rays close to their point of generation in this way would be of great benefit due to the reduced weight of the shielding.

Figure 10:
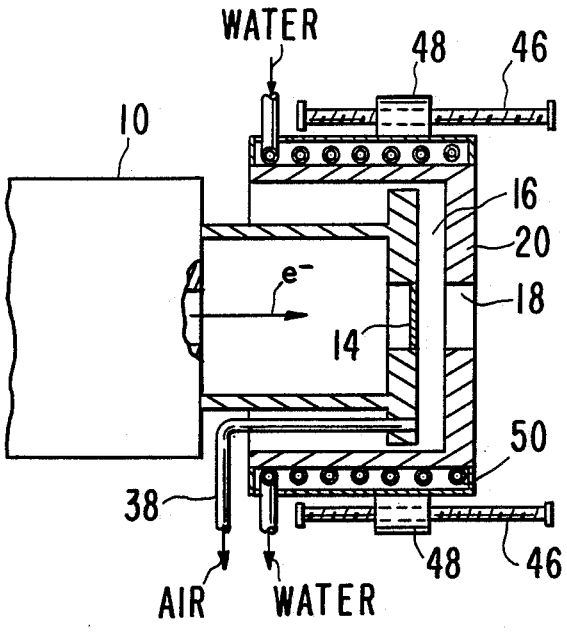

FIG. 10 shows an alternate mechanical embodiment where the translating aperture is located by means of a drive screw 46 and a linear bearing 48. In this embodiment, the cooling fins 36 in FIG. 3 have been replaced with liquid-cooling lines 50 wrapped around the circumference of the side walls. The drive screw allows for mechanical rather than manual positioning of the aperture and the liquid cooling lines allow for greater beam power dissipation in the aperture.

Figure 11:
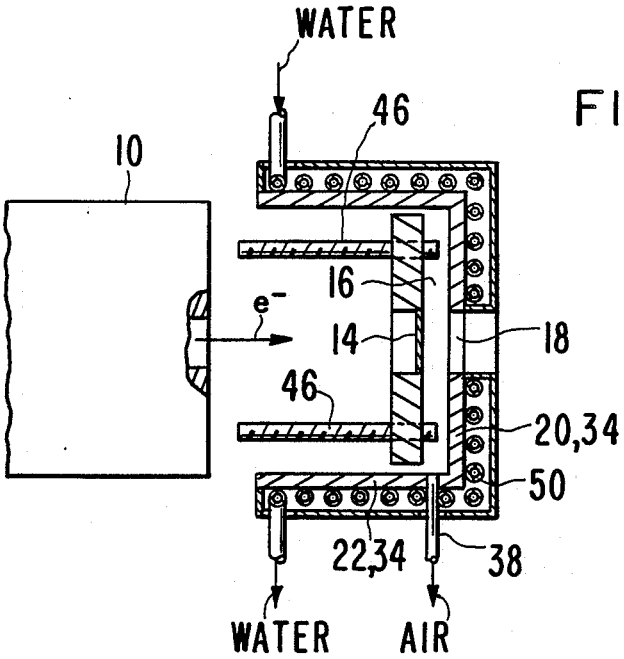

FIG. 11 shows an alternate mechanical embodiment where high-atomic shielding material 34 is used in conjunction with liquid cooling lines 50 for high beam power dissipation applications. The increased shielding weight and complexity of the cooling lines, compared to FIG. 3, would make it impractical to translate the aperture. In this embodiment, the low-weight scattering foil 14 is translated relative to the fixed aperture by means of drive screws 46. The air vent 38 exits directly from the low-density volume 16.

This invention is not limited to the preferred embodiment and alternatives heretofore described, to which variations and improvements may be made, including mechanically and electrically equivalent modifications to component parts, without departing form the scope of protection of the present patent and true spirit of the invention, the characteristics of which are summarized in the following claims.

What is claimed is:

1. An apparatus for reducing the current in a beam from an electron accelerator, comprising:

a chamber made of low atomic number material of thickness sufficient to stop an electron from the beam;

a scattering foil, said foil being substantially perpendicular to a central axis of the electron beam and mounted in said chamber;

a wall of low atomic number material of thickness sufficient to stop any electron from the beam, said wall being substantially symmetrical about the central axis of the electron beam, said wall having a central aperture for passing a portion of electrons scattered from said scattering foil;

said scattering foil been position in thermal contact with said chamber;

said wall been position in good thermal contact with said chamber; and heat dissipation means for moving heat from said chamber.

2. The apparatus of claim 1 wherein said wall has a curved surface facing said scattering foil, said curved surface being shaped so that electrons scattered from said scattering foil strike said surface perpendicularly.

3. The apparatus of claim 1 wherein said heat dissipation means includes means for blowing a stream of air over cooling fins formed on said chamber.

4. The apparatus of claim 1 wherein said heat dissipation means includes tubular coils carrying a coolant to a heat sink.

5. The apparatus of claim 1 wherein said chamber is wrapped in a layer of high-z material for blocking x-rays.

6. The apparatus of claim 1 including means for holding said foil fixed relative to the accelerator and translating said wall along a central axis of the beam.

7. The apparatus of claim 1 including means for holding said wall fixed relative to the accelerator and translating said foil along a central axis of the beam.

8. The apparatus of claim 1 including a second scattering foil mounted in said central aperture.

9. The apparatus of claim 8 including a second wall of low atomic number material of thickness sufficient to stop any electron from the beam, said wall being substantially symmetrical about the central axis of the electron beam, said second wall having a second central aperture for passing a portion of electrons scattered from said second scattering foil and including a third scattering foil mounted in said second central aperture.

10. The apparatus of claim 1 including means for flattening the electron beam mounted across the beam after said wall.

11. The apparatus of claim 1 including means for generating x-rays mounted across the beam after said wall.

12. The apparatus of claim 1 wherein said scattering foil is made of high atomic number material.

13. The apparatus of claim 1 wherein said scattering foil is also a means for reducing the energy of the beam by use of a thick low atomic number scattering foil.

14. A method of reducing the current in a beam from an electron accelerator, comprising the steps of:

spreading the beam of electrons in a scattering foil, and absorbing an outer portion of the beam after spreading in a thick plate having a central aperture to pass a central portion of the beam after spreading.

15. The method of claim 14 including the subsequent step of flattening the lateral distribution of the electrons of the beam.

16. The method of claim 14 including the subsequent step of generating x-rays.

17. The method of claim 14 including the subsequent steps of spreading for a second time the beam of electrons in a scattering foil, and absorbing an outer portion of the beam after spreading for a second time in a thick plate having a central aperture to pass a central portion of the beam after spreading for a second time.

* * * * *